US008882860B2

(12) United States Patent
Inazawa et al.

(10) Patent No.: US 8,882,860 B2
(45) Date of Patent: Nov. 11, 2014

(54) EMULSIFIER FOR WATER-IN-OIL EMULSION FUEL

(71) Applicants: Susumu Inazawa, Kanagawa-ku (JP); Hitoshi Inazawa, Yokohama (JP)

(72) Inventors: Susumu Inazawa, Kanagawa-ku (JP); Hitoshi Inazawa, Yokohama (JP)

( * ) Notice: Subject to any disclaimer, the term of this patent is extended or adjusted under 35 U.S.C. 154(b) by 0 days.

(21) Appl. No.: 14/050,114

(22) Filed: Oct. 9, 2013

(65) Prior Publication Data

US 2014/0075826 A1 Mar. 20, 2014

Related U.S. Application Data

(63) Continuation of application No. 13/138,249, filed as application No. PCT/JP2009/000782 on Feb. 24, 2009, now abandoned.

(30) Foreign Application Priority Data

Jan. 30, 2009 (JP) ..... 2009-019466

(51) Int. Cl.

| | |
|---|---|
| ***C10L 1/02*** | (2006.01) |
| ***C10L 1/182*** | (2006.01) |
| ***C10L 1/32*** | (2006.01) |
| *C10L 1/16* | (2006.01) |
| *C10L 1/18* | (2006.01) |

(52) U.S. Cl.

CPC ..... *C10L 1/328* (2013.01); *C10L 1/1616* (2013.01); *C10L 1/1802* (2013.01); *C10L 1/1824* (2013.01)

USPC ..... 44/302; 44/301; 44/307; 44/308; 585/1; 585/2; 585/3; 585/14; 516/53

(58) Field of Classification Search

CPC ..... C10L 1/328

USPC ..... 137/13; 166/310, 371; 44/301, 302, 44/307, 308; 585/1, 2, 3, 14; 516/53

See application file for complete search history.

(56) References Cited

U.S. PATENT DOCUMENTS

| | | | | |
|---|---|---|---|---|
| 6,187,063 | B1 * | 2/2001 | Gunnerman | 44/301 |
| 6,471,732 | B1 | 10/2002 | Shimada | |
| 2007/0261293 | A1 | 11/2007 | Tajima et al. | |
| 2009/0235573 | A1 * | 9/2009 | Zhang et al. | 44/302 |

FOREIGN PATENT DOCUMENTS

| | | | |
|---|---|---|---|
| CN | 101250447 | A * | 8/2008 |
| JP | 61-047796 | A | 3/1986 |
| JP | 2001-011477 | A | 1/2001 |
| JP | 2001011477 | A * | 1/2001 |
| JP | 2006-002058 | A | 1/2006 |
| JP | 2006-241424 | A | 9/2006 |

OTHER PUBLICATIONS

International Search Report; PCT/JP2009/000782; Apr. 28, 2009.

Japanese Industrial Standard; Fuel Oil; JIS K 2205-1991 Edition 2; UDC 662.753.3; Aug. 16, 1991; Tokyo, Japan.

K.Ohishi; IDE-APEC Study Center, Working Paper Series 95/96—No. 4; Factors Affecting Domestic Price Differentials in the Petroleum Products; Mar. 1996.

M.Toyoda et al.; Sorption and recovery of heavy oils by using exfoliated graphite, Part I: Maximum sorption capacity; Elsevier, Desalination 128; 2000; pp. 205-211.

Seacom Online; Tokico PD Flowmeter for Oil, Diesel, Crude Palm Oil (CPO); www.seacom.com.my/showprod.asp?prodID=111; pp. 1-4.

KR Trading Co., Ltd.; Filter for Mixing Tank; www.krt-eshop.co.jp/products/p09_filter.html; pp. 1-2.

* cited by examiner

*Primary Examiner* — Pamela H Weiss

(74) *Attorney, Agent, or Firm* — Studebaker & Brackett PC

(57) ABSTRACT

An emulsifier for a water-in-oil (W/O) emulsion fuel wherein reseparation between oil and water does not take place for a long period of time because of a stable emulsion state with homogenous dispersion. The emulsifier for a water-in-oil emulsion fuel includes the following (1) to (7) components: (1) heavy oil A: 50 mL or more 100 mL, (2) heavy oil B: 100 mL or more 200 mL, (3) heavy oil C: 300 mL or more 450 mL, (4) methanol: 100 mL or more 150 mL, (5) ethanol: 100 mL or more 200 mL, (6) palm oil: 100 mL or more 150 mL, and (7) water: 100 mL or more 200 mL.

1 Claim, No Drawings

EMULSIFIER FOR WATER-IN-OIL EMULSION FUEL

This is a continuation-in-part application of U.S. patent application Ser. No. 13/138,249, filed Dec. 2, 2011, which is a national stage application of PCT/JP09/000782 filed Feb. 24, 2009 and published in Japanese, which has a priority of Japanese Application No. 2009-019466, filed Jan. 30, 2009, hereby incorporated in their entirety by reference.

BACKGROUND OF THE INVENTION

1. Field of the Invention

The present invention relates to a method for producing an emulsifier for a water-in-oil (W/O) emulsion fuel, wherein the emulsifier can provide a water-in-oil fuel that has extremely good stability of emulsion state between an oil fuel (light oil and heavy oil) and water whereby reseparation between oil and water does not take place for a long period of time (two years or more).

Further, the present invention has an object to prevent pollution by drastically reducing harmful gases and soot/dust emitted in large quantities during burning of an oil fuel (both light oil and heavy oil) and at the same time to improve fuel efficiency by complete burning thereby contributing to an energy saving effect.

2. Description of the Related Art

In the past, an emulsion fuel has been used, as an emulsifier, a chemical such as monoethanol amine, triethanol amine, oleic acid, an aliphatic sulfonate salt, and an alcohol aliphatic acid ester; but these chemicals are expensive thereby leading to a high production cost of the fuel. In addition, an emulsion fuel produced by mixing with these chemicals is unstable in an emulsion state thereof, thereby causing reseparation between an oil and water in a short time after production; and thus, burning must be done simultaneously with emulsification by installing emulsifying equipment together with burning appliances, so that storage management of the fuel itself is impossible. Accordingly, an economic merit is small to many consumers of general small and medium-sized enterprises in view of the burning technique and high cost of emulsifying equipment.

SUMMARY OF THE INVENTION

The present invention solved the problems as mentioned above thoroughly; and thus, storage management can be done in a similar manner to that of a pure oil fuel because an oil and water do not reseparate for a long period of time (two years or more) while keeping a stable emulsion state with a homogeneous dispersion; and in addition, expensive emulsifying equipment and a special burning technique are not necessary because the fuel can be used as it stands in an oil tank and existing burning appliances can be used.

The emulsifier for a water-in-oil emulsion fuel of the present invention comprises the following components (1) to (7):

| | | |
|---|---|---|
| (1) | Heavy oil A: | 50 mL or more 100 mL |
| (2) | Heavy oil B: | 100 mL or more 200 mL |
| (3) | Heavy oil C: | 300 mL or more 450 mL |
| (4) | Methanol: | 100 mL or more 150 mL |
| (5) | Ethanol: | 100 mL or more 200 mL |
| (6) | Palm oil: | 100 mL or more 150 mL |
| (7) | Water: | 100 mL or more 200 mL |

The terms "Heavy Oil", "Heavy Oil A", "Heavy Oil B", and "Heavy Oil C" have a well-recognized meaning in the art. Reference is made to Japanese Industrial Standard JIS K2205. Furthermore, the terms are also generally used in scientific articles and commercial papers. For example, reference is made to "Factors Affecting Domestic Price Differentials in the Petroleum Products," "Sorption and recovery of heavy oils by using exfoliated graphite Part I: Maximum sorption capacity," "Tokico PD Flowmeter for Oil, Diesel, Crude Palm Oil (CPO)," and "Filter for Mixing Tank".

Moreover, such terms are also used in patent publications. U.S. Pat. No. 6,471,732 is such an example, and is incorporated herein in its entirety by reference, as are the Japanese Industrial Standard JIS K2205 and the other cited scientific articles and commercial papers. The terms "Heavy Oil", "Heavy Oil A", "Heavy Oil B", and "Heavy Oil C" have a well-recognized meaning in the art so that these terms are sufficiently clear to one of ordinary skill in the art.

DESCRIPTION OF THE PREFERRED EMBODIMENTS

In other words, to produce the emulsifier of the present invention, firstly components (1), (2), (3), and (4) among the components shown below are mixed by agitation, and into the entirety thereof is added a solution obtained by dissolving components (5), (6), and (7) shown below by agitation; and then the resulting mixture is mixed by agitation with a high speed agitator (3000 or more revolutions per minutes) for 10 minutes to produce the emulsifier of the present invention.

| | | |
|---|---|---|
| (1) | Heavy oil A: | 50 mL or more 100 mL |
| (2) | Heavy oil B: | 100 mL or more 200 mL |
| (3) | Heavy oil C: | 300 mL or more 450 mL |
| (4) | Methanol: | 100 mL or more 150 mL |
| (5) | Ethanol: | 100 mL or more 200 mL |
| (6) | Palm oil: | 100 mL or more 150 mL |
| (7) | Water: | 100 mL or more 200 mL |

The emulsifier produced by the method as mentioned above is in an emulsion state with ultra-atomized homogeneous dispersion (0.5 to 1 micron); and, when this emulsifier is mixed with an oil fuel and water by agitation, the emulsifier diffuses in all directions to effect secondary atomization, so that an emulsion fuel having homogeneous and stable ultra-atomized dispersion can be obtained.

To explain the present invention in detail, into the entirety comprised of 90 to 65% of a light oil fuel (light oil, kerosene, and heavy oil A) and 20 to 35% of water by volume ratio is added 10/1000 or more 30/1000 of the emulsifier of the present invention with agitation for mixing to produce a light oil emulsion fuel in an emulsion state with stable and homogeneous dispersion; and into the entirety comprised of 90 to 60% of a heavy oil fuel (heavy oil B and heavy oil C) and 10 to 40% of hot water (70° C. or higher 90° C.) by volume ratio is added 2/1000 or more 10/1000 of the emulsifier of the present invention with agitation for mixing to produce a heavy oil emulsion fuel in a stable emulsion state with homogeneous dispersion without reseparation for a long period of time.

An emulsion fuel of oil fuel (both light oil and heavy oil) produced by using the emulsifier of the present invention is in an emulsion state under which ultra-atomized water particles are dispersed homogeneously and stably into an oil, thereby enabling stable and complete burning; and as a result, not only energy is saved due to improvement of burning efficiency by burning of an unburnt portion, elimination of soot in an exhaust gas, and so on, but also pollution prevention effects are large because generation of harmful exhaust gases such as nitrogen oxides, soot, dust, and so on can be drastically reduced.

In addition, a large economical merit can be obtained because the emulsifier is remarkably cheap as compared with conventional emulsifiers.

EXAMPLE 1

Finally, by using the emulsifier of the present invention, an emulsion fuel of heavy oil A, an emulsion fuel of heavy oil B, and an emulsion fuel of heavy oil C were produced and burning tests were conducted on each foregoing fuel; and the following results were obtained.

1. Emulsion Fuel of Heavy Oil A

Into 8 liters (80%) of heavy oil A and 2 liters (20%) of water was added 50/1000 (relative to entirety of heavy oil A and water) of the emulsifier having the following composition:

| | |
|---|---|
| Heavy oil A: | 100 mL |
| Heavy oil B: | 150 mL |
| Heavy oil C: | 300 mL |
| Methanol: | 150 mL |
| Ethanol: | 100 mL |
| Palm oil: | 100 mL |
| Water: | 100 mL |

2. Emulsion Fuel of Heavy Oil C

Into 10 liters (75.8%) of heavy oil C and 3.2 liters (24.2%) of water was added 25/1000 (relative to entirety of heavy oil B and water) of the emulsifier having the same composition as afore-mentioned.

TABLE 1

Comparison of emulsion state stability, NO*x* concentration, and soot/dust concentration

| Material of present invention Examples (based on kinds of oil) | Amount of oil | Amount of water | Amount of added emulsifie | Particle diameter of dispersed water (m) | Emulsion state | Nox concentration equivalent (02 = 4% value) | Soot/dust concentration (g/NM3) |
|---|---|---|---|---|---|---|---|
| Heavy oil A for single burning | 100 | | | | | 86 | 0.016 |
| Emulsion fuel of heavy oil A | 80 | 20 | 0.50% | 2~3 | Homogeneous dispersion | 28 | 0.0024 |
| Heavy oil B for single burning | 100 | | | | | 137 | 0.023 |
| Emulsion fuel of heavy oil B | 100 | 32 | 0.25% | 2~3 | Homogeneous dispersion | 63 | 0.0027 |
| Heavy oil C for single burning | 100 | | | | | 98 | 0.044 |
| Emulsion fuel of heavy oil C | 100 | 32 | 0.25% | 2~3 | Homogeneous dispersion | 54 | 0.019 |
| Commercial product | | | Commercial emulsifier | | | | |
| Emulsion fuel of heavy oil A | 100 | 30 | 0.50% | 5~10 | | 57 | 0.005 |
| Emulsion fuel of heavy oil B | 100 | 30 | 0.50% | 5~10 | | 113 | 0.038 |
| Emulsion fuel of heavy oil C | 100 | 30 | 0.50% | 5~10 | | 120 | 0.067 |

TABLE 2

Comparison of fuel consumption, unit price of emulsifier, and burning state

| Emulsion fuel according to emulsifier of present invention | Consumption (L/H) | Heavy oil equivalent (L/H) | Unit price of emulsifier (L/yen) | Burning state |
|---|---|---|---|---|
| Heavy oil B for single burning | 37 | 37 | — | Excellent |
| Emulsion fuel of heavy oil B (24% water, addition of 1/400 emulsifier) | 31 | 23. 75 | 2.5 | Excellent |
| Heavy oil C for single burning | 35 | 35 | — | Excellent |
| Emulsion fuel of heavy oil C (24% water, addition of 1/400 emulsifier) | 36.7 | 28.2 | 2.5 | Excellent |
| Commercial product | | | | |
| Heavy oil B for single burning | 37 | 37 | — | Excellent |
| Emulsion fuel of heavy oil B (24% water, addition of 1/400 emulsifier) | 36.8 | 29.7 | 6 | Excellent |

In Table 1, comparison is made on each emulsion fuel of heavy oil A, heavy oil B, and heavy oil C, which are produced by using the emulsifier of the present invention, versus other commercial emulsion fuel with regard to generation of nitrogen oxides and soot/dust during burning; it was found that amounts of nitrogen oxides generated were less by 60% in emulsion fuel of heavy oil A, by 44% in emulsion fuel of heavy oil B, and by 55% in emulsion fuel of heavy oil C, as compared with other commercial emulsion fuel, and that amounts of soot/dust generated were less by 52% in emulsion fuel of heavy oil A, by 93% in emulsion fuel of heavy oil B, and by 72% in emulsion fuel of heavy oil C, as compared with other commercial emulsion fuel. Accordingly, it was confirmed that the emulsion fuel using the emulsifier of the present invention had extremely large pollution prevention effects as compared with other commercial emulsion fuel.

Note: Analysis methods are as following.

| | | |
|---|---|---|
| (1) | Concentration of nitrogen oxides: | JIS K 0104 |
| (2) | Concentration of soot/duct: | JIS Z 8868 |

The results shown in Table 2 were obtained by actual measurement of continuous burning of both emulsion fuel of heavy oil B and emulsion fuel of heavy oil C with a boiler used in a public bath for one week; and it can be seen that a large energy-saving effect could be obtained.

It has been said that an emulsion fuel has various effects (energy savings, clean exhaust gas, and so on); but in order to realize the effects fully without problems, a highly stable emulsion fuel needs to be produced. When the emulsifier of the present invention is used, an emulsion fuel of each kind of oils in a stable homogeneous emulsion state with ultra-atomized dispersion can be obtained, thereby enabling storage of the emulsion fuel for a long period of time, which has been impossible in a conventional emulsion fuel. As a result, emulsification equipment attached to burning appliances is not necessary anymore; and thus, existing burning appliances for pure oil fuel can be used. Further in addition, an original aim of an emulsion fuel, that is, an energy-savings effect and a pollution preventive effect, can also be achieved fully by using the emulsifier of the present invention.

We claim:

1. An emulsifier for a water-in-oil emulsion fuel, the emulsifier comprising components (1) to (7):

| | | |
|---|---|---|
| (1) | Heavy oil fuel A: | 50 mL to 100 mL; |
| (2) | Heavy oil fuel B: | 100 mL to 200 mL; |
| (3) | Heavy oil fuel C: | 300 mL to 450 mL; |
| (4) | Methanol: | 100 mL to 150 mL; |
| (5) | Ethanol: | 100 mL to 200 mL; |
| (6) | Palm oil: | 100 mL to 150 mL; and |
| (7) | Water: | 100 mL to 200 mL; |

wherein heavy oil fuel A is a fuel oil having a flash point ° C. of 60 minimum, a kinematic viscosity at 50° C. in $mm^2/S$ of 20 maximum, a pour point ° C. of 5 maximum, a residual carbon content mass % of 4 maximum, a water content volume % of 0.3 maximum, an ash content mass % of 0.05 maximum, and a sulfur content mass % of 2.0 maximum, wherein heavy oil fuel B is a fuel oil having a flash point ° C. of 60 minimum, a kinematic viscosity at 50° C. in $mm^2/S$ of 50 maximum, a pour point ° C. of 10 maximum, a residual carbon content mass % of 8 maximum, a water content volume % of 0.4 maximum, an ash content mass % of 0.05 maximum, and a sulfur content mass % of 3.0 maximum, and wherein heavy oil fuel C is a fuel oil having a flash point ° C. of 70 minimum, a kinematic viscosity at 50° C. in $mm^2/S$ of 1000 maximum, a water content volume % of 2.0 maximum and an ash content % of 0.1 maximum, and a sulfur content mass % of 3.5 maximum.

* * * * *